US010900733B2

(12) United States Patent
Itzhakian et al.

(10) Patent No.: US 10,900,733 B2
(45) Date of Patent: Jan. 26, 2021

(54) FIREARM CONTROLLED BY USER BEHAVIOR

(71) Applicant: ISRAEL WEAPON INDUSTRIES (I.W.I.) LTD., Ramat HaSharon (IL)

(72) Inventors: Oren Itzhakian, Soham (IL); Aviram Sobol, Netanya (IL); Zeev Shneorson, Raanana (IL); Naor Sagy, Tel Aviv (IL)

(73) Assignee: ISRAEL WEAPON INDUSTRIES (I.W.I) LTD., Ramat Hasharon (IL)

( * ) Notice: Subject to any disclaimer, the term of this patent is extended or adjusted under 35 U.S.C. 154(b) by 0 days.

(21) Appl. No.: 16/362,656

(22) Filed: Mar. 24, 2019

(65) Prior Publication Data

US 2020/0182576 A1 Jun. 11, 2020

(30) Foreign Application Priority Data

Dec. 9, 2018 (IL) ..... 263603

(51) Int. Cl.

| | |
|---|---|
| ***F41A 17/08*** | (2006.01) |
| ***F41A 35/00*** | (2006.01) |
| ***F41A 19/59*** | (2006.01) |
| ***F41A 19/64*** | (2006.01) |

(52) U.S. Cl.

CPC ..... *F41A 19/59* (2013.01); *F41A 17/08* (2013.01); *F41A 19/64* (2013.01); *F41A 35/00* (2013.01)

(58) Field of Classification Search

CPC ..... F41G 3/04; F41G 3/06; F41G 3/08; F41G 3/14; F41G 3/16; F41G 3/165; F41A 17/08

See application file for complete search history.

(56) References Cited

U.S. PATENT DOCUMENTS

| | | | | |
|---|---|---|---|---|
| 3,766,826 | A | 10/1973 | Salomonsson | |
| 5,392,688 | A * | 2/1995 | Boutet | F41A 17/08 89/41.06 |
| 5,966,859 | A * | 10/1999 | Samuels | F41A 17/066 42/70.11 |
| 6,321,478 | B1 | 11/2001 | Klebes | |
| 6,796,213 | B1 * | 9/2004 | McKendree | F41A 17/08 89/1.11 |
| 6,871,439 | B1 * | 3/2005 | Edwards | F42B 5/035 42/84 |

(Continued)

FOREIGN PATENT DOCUMENTS

| | | |
|---|---|---|
| EP | 3077757 B1 | 4/2018 |
| KR | 10-1468160 B1 | 12/2014 |

*Primary Examiner* — Gabriel J. Klein

(74) *Attorney, Agent, or Firm* — Soroker Agmon Nordman

(57) ABSTRACT

A method of controlling the release of bullets from a firearm by user behavior, including monitoring the spatial orientation of a virtual vector representing the orientation of a barrel of the firearm by receiving measurements from sensors installed in or on the firearm, engaging a trigger of the firearm to release a first bullet to a first direction, while the trigger is engaged continuously analyzing the measurements to identify preconfigured motion patterns, releasing bullets automatically responsive to identifying the preconfigured motion patterns, wherein the preconfigured motion patterns include identifying that the user is stabilizing the firearm toward a target that is in a direction that is distinct from the first direction.

20 Claims, 15 Drawing Sheets

(56) References Cited

U.S. PATENT DOCUMENTS

| | | | | |
|---|---|---|---|---|
| 8,989,449 | B2 | 3/2015 | Backlund et al. | |
| 9,033,232 | B2 | 5/2015 | Bockmon | |
| 9,222,754 | B2 | 12/2015 | Lupher et al. | |
| 9,395,155 | B1 | 7/2016 | Bockmon | |
| 9,557,130 | B2 | 1/2017 | Shneorson et al. | |
| 9,945,640 | B2 | 4/2018 | Lyren | |
| 2002/0174588 | A1 | 11/2002 | Danner et al. | |
| 2006/0005447 | A1* | 1/2006 | Lenner | F41G 3/165 42/111 |
| 2013/0028486 | A1* | 1/2013 | Backlund | F41A 19/64 382/107 |
| 2014/0028856 | A1* | 1/2014 | Ehrlich | F41G 3/12 348/169 |
| 2014/0110482 | A1* | 4/2014 | Bay | F41G 1/44 235/404 |
| 2014/0360072 | A1* | 12/2014 | Lupher | F41G 1/38 42/69.01 |
| 2015/0101229 | A1* | 4/2015 | Hall | F41G 3/00 42/69.01 |
| 2015/0211828 | A1* | 7/2015 | Lupher | F41A 19/58 42/69.01 |
| 2015/0345887 | A1 | 12/2015 | Shneorson et al. | |
| 2016/0316128 | A1* | 10/2016 | Teich | H04N 5/77 |
| 2017/0176144 | A1* | 6/2017 | Zhang | F41G 3/06 |
| 2019/0137219 | A1* | 5/2019 | Bockmon | F41G 5/14 |
| 2019/0145738 | A1* | 5/2019 | Chae | F41A 19/08 89/41.05 |
| 2019/0310042 | A1* | 10/2019 | Himmich | F41A 17/08 |

* cited by examiner

300

| TARGET STATUS / SHOOTER STATUS | ORIGINAL STATIONARY TARGET | MOBILE TARGET | ALTERNATING TARGET |
|---|---|---|---|
| STATIONARY | (1) FIREARM STABLE IN ORIGINAL BULLET DIRECTION | (2) FIREARM MOVING WITH STEADY MOTION | (3) FIREARM STABLE IN NEW DIRECTION |
| IN MOTION | (4) FIREARM STABLE IN ORIGINAL BULLET DIRECTION AND ADVANCING TOWARD THE TARGET | (5) FIREARM MOVING WITH STEADY MOTION | (6) FIREARM MOVING WITH STEADY MOTION ALONG AN AXIS TOWARD THE TARGET |

FIG. 3

FIREARM CONTROLLED BY USER BEHAVIOR

FIELD OF THE DISCLOSURE

The present disclosure relates generally to handheld firearms and more specifically to a firearm that automatically releases bullets responsive to behavior of a user.

BACKGROUND OF THE DISCLOSURE

In many cases firearms are used in dangerous situations, for example where a user is under pressure to respond rapidly and accurately to threats. In actuality the user needs to take specific actions to neutralize a threat, including identifying the threat, aiming the firearm, squeezing the trigger to release a bullet or round of bullets, assessing the results and repeating actions. Reducing the required actions can increase the speed of the user in neutralizing a threat and may make a difference between life and death.

U.S. Pat. No. 9,557,130 dated Jan. 31, 2017 the disclosure of which is incorporated herein by reference, describes an apparatus and method for improving hit probability of a firearm. The patent describes a firearm that prevents misfire in which the user aims then presses and holds the trigger to release a first bullet. The aim of the firearm may deviate from the target due to the recoil of the firearm or other distractions. The firearm is designed to automatically (while the trigger is engaged) release additional bullets when the user manages to re-aim the firearm to approximately the same direction as when releasing the first bullet.

The above method eliminates the need of the user to accurately re-aim the barrel of the firearm and then press the trigger when reaching the desired position, rather it is sufficient to only point the barrel to the approximate direction previously acquired and the firearm releases bullets when the barrel is pointed correctly. This method has been found to increase the shooting rate and ability of the user to hit a target and improve lethality. The above method is excellent for motionless shooter and motionless target. However if either is moving it will not improve the hit probability. Likewise if the user wishes to fire at a new target he must release the trigger and start over. Accordingly in some situations a different system and scheme is desirable.

SUMMARY OF THE DISCLOSURE

An aspect of an embodiment of the disclosure, relates to a firearm that controls the release of bullets based on behavior of the user. The firearm includes sensors that track the motion of the firearm and enable monitoring a virtual vector tracking the direction in which the barrel of the firearm is pointing. The firearm further includes a controller that monitors the measurements of the sensors and analyzes them to determine if they indicate the occurrence of preconfigured motion patterns corresponding to actions of the user. The firearm further includes a trigger that is engaged by the user to release a first bullet toward a target and then as long as it is engaged analyze the measurements to identify the occurrence of the preconfigured motion patterns. The preconfigured motion patterns include at least a case in which the user shoots a first bullet at a target and then swerves the barrel toward a new target and stabilizes the firearm in the direction, of the new target while keeping the trigger engaged.

Additional preconfigured motion patterns may include shooting at a first target and then moving the barrel of the firearm to track a moving target. The controller may take into account recoil motion, user motion due to carrying the firearm and user motion due to attempts to stabilize the firearm in a specific direction (e.g. pointing the barrel toward a target).

In some embodiments of the disclosure, the firearm has different selectable operation modes such as safe mode, semi-automatic, burst and automatic as commonly implemented in firearms. Likewise the current firearm may include one or more new operation modes, which allow the automatic release of bullets responsive to the user motion patterns as explained above. Optionally, the firearm supports more than one mode in which the controller is configured to handle the sensed measurements differently, for example one mode may assume that the user is stationary and one mode may assume the user is moving and analyze the sensor measurements accordingly.

There is thus provided according to an exemplary embodiment of the disclosure, a method of controlling the release of bullets from a firearm by user behavior, comprising:

Monitoring the spatial orientation of a virtual vector representing the orientation of a barrel of the firearm by receiving measurements from sensors installed in or on the firearm;

Engaging a trigger of the firearm to release a first bullet to a first direction;

While the trigger is engaged continuously analyzing the measurements to identify preconfigured motion patterns;

Releasing bullets automatically responsive to identifying the preconfigured motion patterns;

Wherein the preconfigured motion patterns include identifying that the user is stabilizing the firearm toward a target that is in a direction that is distinct from the first direction.

In an exemplary embodiment of the disclosure, the preconfigured motion patterns include moving the firearm to track a moving target. Optionally, the preconfigured motion patterns further include that the user is also moving.

In an exemplary embodiment of the disclosure, the preconfigured motion patterns include that the user stabilizes the firearm toward a stationary target. Optionally, the preconfigured motion patterns further include that the user is also moving.

In an exemplary embodiment of the disclosure, the sensors include multiple chips installed on a planar surface, which are rotated relative to each other and each chip comprising an accelerometer and a gyroscope. Optionally, the sensors include an optical sensor or an IR/thermal sensor. In an exemplary embodiment of the disclosure, stabilizing, the firearm toward a target comprises aiming the firearm so that it wobbles around an axis directed from the firearm to the target and the wobbling's are essentially restricted within a limited error window around the axis. In an exemplary embodiment of the disclosure, the firearm limits the release of bullets to specific spatial boundaries relative to the first direction. Optionally, the firearm provides an indication if the bullets depleted.

In an exemplary embodiment of the disclosure, the user selects a behavioral controlled operation mode to enable the firearm to automatically release bullets instead of only releasing bullets manually. Alternatively or additionally, the firearm includes a separate behavioral controlled operation mode for handling a stationary user and a separate behavioral controlled operation mode for handling a moving user.

There is further provided according to an exemplary embodiment of the disclosure, a firearm that controls the release of bullets based on user behavior, comprising:

One or more sensors that provide measurements to determine the spatial orientation of a barrel of the firearm;

A controller that monitors the spatial orientation of a virtual vector representing the orientation of the barrel of the firearm;

A trigger to indicate that the user is interested in releasing bullets when the user engages the trigger;

Wherein a first bullet is released to a first direction when the user initially engages the trigger and while the trigger is engaged the controller is configured to:

Continuously analyze the measurements received from the sensors to identify preconfigured motion patterns; and release bullets automatically responsive to identifying the preconfigured motion patterns; and Wherein the preconfigured motion patterns include identifying that the user is stabilizing the firearm toward a target that is in a direction that is distinct from the first direction.

In an exemplary embodiment of the disclosure, the preconfigured motion patterns include moving the firearm to track a moving target. Optionally, the preconfigured motion patterns further include that the user is also moving.

In an exemplary embodiment of the disclosure, the preconfigured motion patterns include identifying that the user stabilizes the firearm toward a stationary target. Optionally, the preconfigured motion patterns further include that the user is also moving.

In an exemplary embodiment of the disclosure, the sensors include multiple chips installed on a planar surface, which are rotated relative to each other and each chip comprising an accelerometer and a gyroscope. Optionally, the sensors include an optical sensor or an IR/thermal sensor. In an exemplary embodiment of the disclosure, stabilizing the firearm toward a target comprises aiming the firearm so that it wobbles around an axis directed from the firearm to the target and the wobbling's are essentially restricted within a limited error window around the axis. Optionally, the firearm limits the release of bullets to specific spatial boundaries relative to the first direction. In an exemplary embodiment of the disclosure, the firearm provides an indication if the bullets depleted.

In an exemplary embodiment of the disclosure, the firearm includes a manual mode and a behavioral controlled operation mode to enable the firearm to automatically release bullets based on user behavior instead of only releasing bullets manually. Alternatively or additionally, the firearm includes a separate behavioral controlled operation mode for handling a stationary user and a separate behavioral controlled operation mode for handling a moving user.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein:

FIG. 3 is a state table of various motion patterns, according to an exemplary embodiment of the disclosure;

DETAILED DESCRIPTION

Figure 1A:
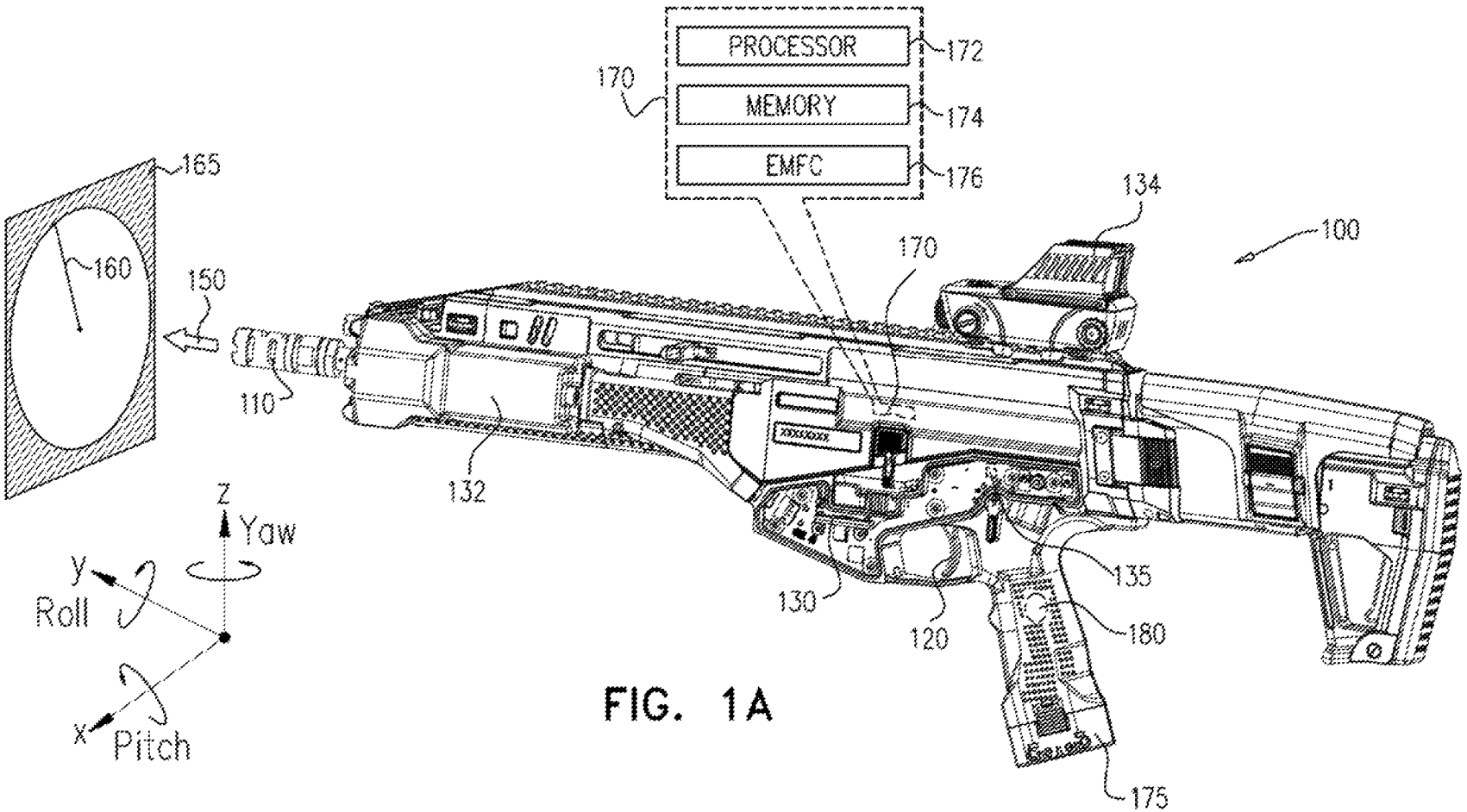
FIG. 1A is a schematic illustration of a behavior controlled firearm, according to an exemplary embodiment of the disclosure.
Figure 1B:
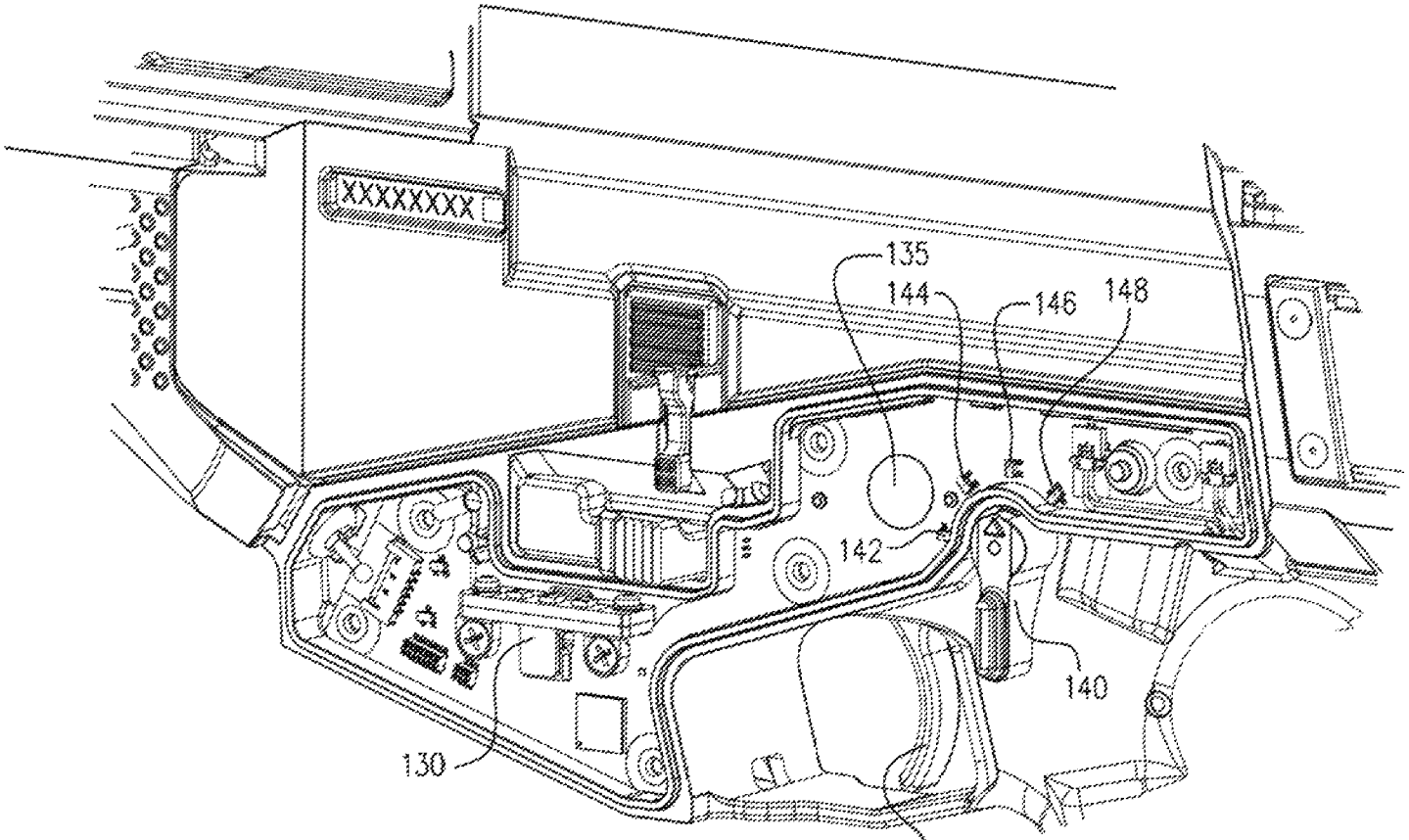
FIG. 1B is a schematic illustration of an enlarged view of the trigger of a behavior controlled firearm, according to an exemplary embodiment of the disclosure.
Figure 1C:
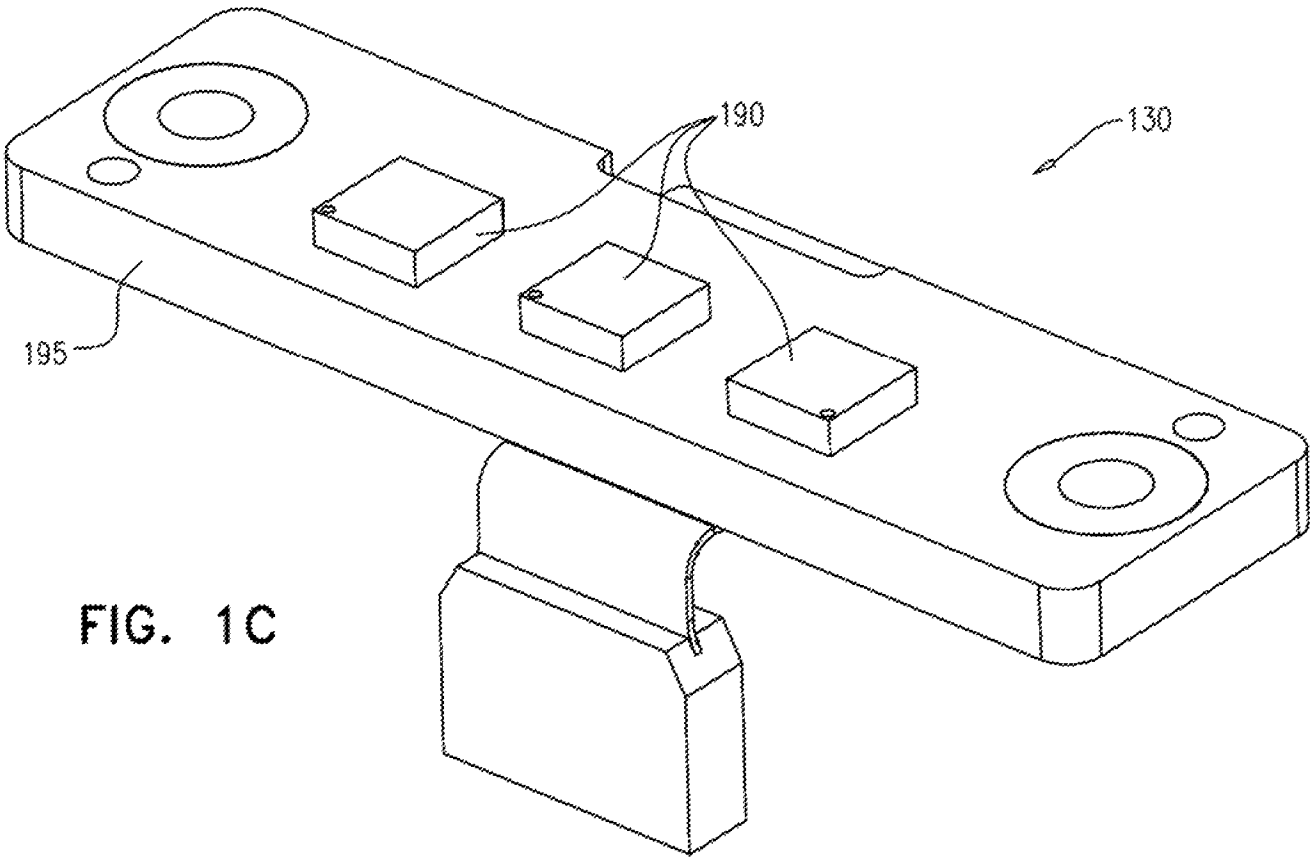
FIG. 1C is a schematic illustration of position sensors of a behavior controlled firearm, according to an exemplary embodiment of the disclosure.

FIG. 1A is a schematic illustration of a behavior controlled firearm 100 and FIGS. 1B and 1C are enlarged views of elements of the behavior controlled firearm 100, according to an exemplary embodiment of the disclosure. Firearm 100 is a semi-automatic or fully automatic firearm including a barrel 110, a mode selector 140 and a trigger 120 for releasing a bullet or sequence of bullets through the barrel toward a target. Optionally, the mode selector 140 enables a user to select various modes (see FIG. 1B), for example;

1. A safe mode (142) that prevents release of bullets from the firearm 100;
2. A semi-automatic mode (144) that enables release of a single bullet every time the trigger is engaged;
3. A burst mode (not shown) that releases a specific number of bullets each time the trigger is engaged;
4. An automatic mode (146) that releases bullets as long as the trigger is engaged;

And

5. A user behavior controlled mode (148) in which the firearm releases a first bullet and releases additional bullets automatically while the trigger is engaged responsive to sensing and analyzing the behavior/actions of the user with the firearm.

Some firearms may include more selectable modes and some firearms may include less modes. In some embodiments of the disclosure, firearm 100 includes multiple user behavior controlled modes to handle different situations based on the user selection. For example one mode is selected by the user to handle a situation in which the user is stationary and aims the firearm 100, and a second mode is selected to handle a situation in which the user is in motion toward a target. Optionally, by selecting an appropriate mode the firearm 100 can respond more accurately to the motion of the user and firearm 100. Likewise by dividing into two modes the complexity of analyzing motion by the firearm is simplified. Optionally, each User behavior controlled mode (148) induces a presumption that the user is acting according to the selected mode, for example basically stable or basically walking or running. The presumption may affect the response of the fire arm to the measurements provided by the sensors, so that the firearm 100 may respond differently to the same motion based on the selected mode.

In an exemplary embodiment of the disclosure, firearm 100 includes a trigger status monitor 135 that identifies if the trigger 120 is engaged (i.e. pressed by the user) or released. Optionally, trigger status monitor 135 may identify the status of the trigger 120 by a mechanical connection that moves with the trigger 120, by an electrical connection for example by closing or opening a circuit when the trigger 120 is engaged, by a Hall Effect sensor or by an optical element that identifies the position of the trigger 120. In an exemplary embodiment of the disclosure, the sear of the firearm is held or released responsive to the position of the trigger and calculations of a controller 170 to withhold or release the sear to fire bullets. Optionally, an electromagnet or other means may be used to hold and release the sear of the firearm.

In an exemplary embodiment of the disclosure, firearm 100 also includes a power source 175, for example a battery to power elements of the firearm that require electrical power. Optionally, the power source 175 may be rechargeable.

In an exemplary embodiment of the disclosure, firearm 100 includes one or more sensors 130, 132 or 134 (as shown in FIG. 1A) to determine the spatial orientation of the firearm 100 and identify motion and acceleration of the firearm 100. The sensors 130 may include a gyroscope, an accelerometer, a magnetometer and/or other sensors such as a temperature sensor, RF radar or ultrasonic radar. Likewise sensors 132 may include an image sensor, a light sensor, an infrared (thermal) sensor, an optical sensor or a laser spot detection system. Alternatively or additionally, the sensor may be in the form of an optical sight 134. The sensors 130, 132 and 134 may be positioned inside the firearm 100, on the body of the firearm 100 or in an element attached to the firearm, for example as part of an optic sight 134 installed on the firearm 100. Optionally, the sensors 130, 132 and 134 may be one dimensional, two dimensional or three dimensional. The readings of the sensors 130, 132 and 134 may be provided to the controller 170 to monitor the motion of the firearm 100. In an exemplary embodiment of the disclosure, controller 170 includes a processor 172, a memory 174 and an electromechanical fire control (EMFC) 176 or other type of fire control (e.g. an electromagnetic system: a solenoid or motor and the like) that controls the release of bullets when the trigger 120 is engaged. The processor 172 and memory 174 are configured to analyze the measurements received from the sensors 130, 132 and 134, identify user behavior and firearm motion based on motion patterns of the firearm. If the identified behavior or motion fits a pre-selected pattern or set of patterns, controller 170 instructs the electromechanical fire control (EMFC) 176 to release a bullet.

In an exemplary embodiment of the disclosure, when the firearm releases a bullet the controller 170 may construct a virtual vector 150 designating the direction of the barrel 110 of the firearm. Controller 170 monitors changes to the spatial orientation of the virtual vector 150 and decides if to release a bullet or multiple bullets responsive to the path or motion of the vector 150.

In an exemplary embodiment of the disclosure, sensors 130 may comprise of one or more integrated circuits 190 as shown in FIG. 1C. The integrated circuits may include:

1. Bosch BNO055 intelligent 9-axis absolute orientation sensor by Bosch Sensortec GmbH from Germany, which includes a triaxial 16 bit gyroscope, a versatile leading edge triaxial 14 bit accelerometer and a geomagnetic sensor;
2. ST LSM9DS1 iNEMO inertial module by STMicroelectronics from Geneva Switzerland including a 3D accelerometer, a 3D gyroscope and a 3D magnetometer;
3. NXP FXOS8700CQ 6-axis sensor with integrated linear accelerometer and magnetometer from NXP Semiconductors, which includes a 3-axis linear accelerometer and a 3-axis magnetometer; and
4. ICM-20649 a 6 axis MEMS motion tracking integrated circuit by InvenSense from San Jose Calif., which includes a 3 axis gyroscope, a 3 axis accelerometer and a digital motion processor (DMP) to analyze the measurements and reduce the computational needs from processor 172 or to serve as processor 172. Optionally, other known motion sensor circuits may be used.

In some embodiments of the disclosure, multiple integrated circuits 190 are used, for example three integrated circuits 190 may be installed on a single planar surface 195 (as shown in FIG. 1C) to simplify installation in firearm 100. In some embodiments of the disclosure, one of the integrated circuits 190 is rotated by 90° relative to the other two to enhance accuracy of the measurements. Alternatively, each of the integrated circuits 190 may be rotated differently to enhance accuracy of the measurements.

Figure 2:
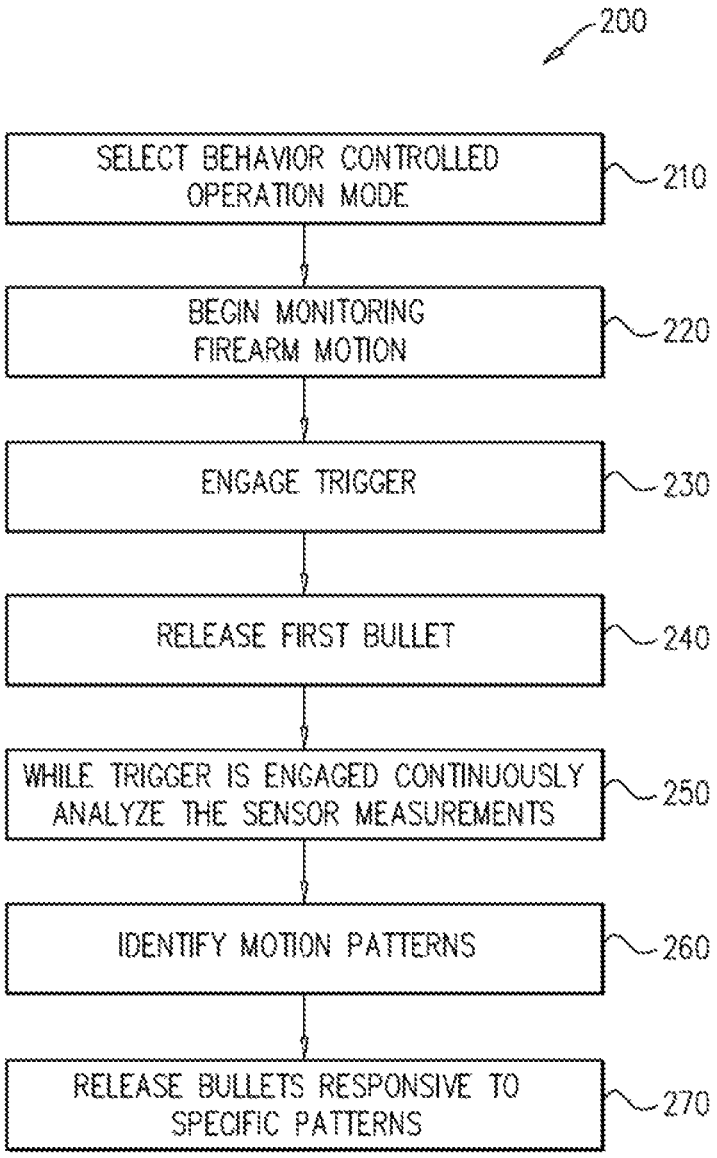
FIG. 2 is a flow diagram of a method of controlling release of bullets from a firearm based on the behavior of a user, according to an exemplary embodiment of the disclosure.

FIG. 2 is a flow diagram of a method 200 of controlling the release of bullets from firearm 100 based on the behavior of a user, according to an exemplary embodiment of the disclosure. Initially the user selects an operation mode (142, 144, 146, 148), which defines for the firearm 100 if and how the firearm will respond to user behavior, which is detected by the motion of the firearm. Optionally, the user can select that the firearm 100 will function as a standard firearm (142, 144, 146), for example releasing bullets directly responsive to engaging the trigger 120. Alternatively, the user can select (210) a behavior controlled mode 148 (optionally, there may be more than one behavior controlled mode) that releases bullets responsive to user behavior (e.g. engaging the trigger and performing motion patterns that provide indication of the user's intention.

Once the user selects (210) the behavior controlled mode 148, controller 170 may begin monitoring (220) the status of the firearm 100 to determine from the motion pattern if the firearm 100 is essentially stationary or if for example it is being carried by a user that is walking or running. Optionally, controller 170 analyzes the sensor measurements to form a virtual vector 150 designating the direction and motion of the barrel over time. When the user engages (230) the trigger a first bullet is released (240). Optionally, while trigger 120 is engaged, controller 170 continuously analyzes the measurements of the sensors 130 to identify motion patterns, for example:

A) If the firearm 100 is being carried by a stationary/walking/running user;

B) If the user is stabilizing the barrel to aim the firearm toward a target;

C) If the user is moving the firearm at a steady rate to track motion of a target; and D) Recoil of a bullet.

Optionally, the analysis is based on the overall motion (e.g. based on the general motion of the firearm—pitch (X)—rotation about the lateral axis, yaw (Z) rotation about the normal axis and roll (Y)—rotation about the longitudinal axis—see coordinates in FIG. 1A), timing of accelerated motion (e.g. if the user makes sudden changes in the direction of the barrel or alternatively moves the barrel with a constant angular speed) or if the user keeps the virtual vector 150 stable aiming approximately in a specific direction (e.g. wobbling around a specific axis essentially within a limited radius 160 or within a defined boundary defining an error window 165). The measurements from the sensors 130, 132 and 134 are optionally stored in memory 174. In an exemplary embodiment of the disclosure, processor 172 checks backward for a predetermined amount of time to determine if a relevant motion pattern can be identified. In some cases a relevant motion pattern may be detected only after a specific time interval has passed providing enough information to identify behavior of the user.

In an exemplary embodiment of the disclosure, while the trigger is engaged controller 170 continuously analyzes (250) the sensor measurements to identify (260) motion patterns. Optionally, when identifying a motion pattern, electromechanical fire control (EMFC) 176 of controller 170 will release (270) bullets according to the rules of the pattern.

FIG. 3 is a state table 300 of various motion patterns, according to an exemplary embodiment of the disclosure. Optionally, the following six cases are recognized by firearm 100 for releasing bullets while the user holds/engages trigger 120.

The user may be stationary or the user may be in motion (walking/running) and the target may be: 1) stationary, 2) in motion, 3) alternating.

For example:

1) The stationary user may fire at a stationary target and due to recoil or distraction the barrel 110 of the firearm 100 may recoil or jerk away. Optionally, controller 170 identifies this motion pattern (returning and stabilizing on an initial target) and instructs electromechanical fire control (EMFC) 176 to release bullets (while the trigger is engaged) when the firearm barrel 110 (or virtual vector 150) is stabilized to approximately (up to a preselected radius 160 or error window 165) point to the direction in which the first bullet was fired.

2) The stationary user may fire a bullet at a moving target and then move the firearm 100 with e.g. a steady continuous motion to track the moving target. Controller 170 releases bullets when identifying this motion pattern (steady/continuous motion of the firearm 100 while the trigger is engaged).

3) The stationary user releases a first bullet toward a target and then (while the trigger is engaged) quickly moves the firearm toward a new target and then stabilizes the firearm to point at the new target. Controller 170 will identify this motion pattern (quick accelerated motion and stabilizing) and release additional bullets toward the new target while stabilized until the user moves the firearm again. Thus the user can quickly fire at multiple targets without releasing and reengaging the trigger.

4) The moving user (e.g. walking) may fire a first bullet at a stationary target and in spite of the user motion the user continuously stabilizes the barrel toward the stationary target. Alternatively, the moving user may halt and stabilize expecting an additional bullet to be released (while the trigger is engaged). Optionally, controller 170 identifies this motion pattern (stabilizing the virtual vector 150 toward a stationary target by a user in motion or by a user that suddenly halted) and instructs EMFC 176 to release bullets when the firearm barrel 110 (or virtual vector 150) is stabilized by the user to approximately point to the same direction as the first bullet fired (up to a preselected radius 160 or error window 165).

5) The moving user may fire at a moving target and then continuously move the firearm with e.g. steady motion while moving (e.g. walking), to track the moving target. Alternatively, the moving user may halt and rotate to track the moving target when expecting an additional bullet to be released (while the trigger is engaged). Controller 170 releases bullets when identifying this motion pattern (steady rotation of the firearm 100 while the user is moving or when the user suddenly halts but keeps tracking the target).

6) The moving user releases a first bullet toward a target and then quickly move the firearm toward a new target (while the trigger is engaged), stabilizing the firearm to point at the new target while the user is in motion. Alternatively, the moving user may halt and stabilize on the new target when desiring that an additional bullet be released. Controller 170 will identify this motion pattern (quick movement to a new target and stabilizing while moving or immediately after halting to aim and stabilize) and release additional bullets toward the new target while stabilized until the user moves the firearm again. Thus the user can quickly fire at multiple targets without releasing and reengaging the trigger 120.

In an exemplary embodiment of the disclosure, firearm 100 prevents the release of bullets when moving with irregular (e.g. jerky/randomly accelerating) motion. Optionally, bullets are released when the firearm is essentially stable for a minimal preselected amount of time (e.g. 0.1 seconds, 0.5 seconds, 1 second or other time lengths). Likewise bullets may be released when the firearm exhibits steady motion (e.g. linear motion at an approximately steady speed).

In some embodiments of the disclosure, firearm 100 limits the release of bullets to specific spatial boundaries relative to the direction of the first bullet, for example even though the trigger 120 is engaged, firearm 100 limits the release of bullets to specific maximum angles around the direction of the first bullet.

In some embodiments of the disclosure, the automatic release of bullets is time limited, for example if the user does not form motion that causes release of bullets within a predefined amount of time (e.g. 10-100 seconds) after release of the first bullet or a previous bullet, the controller 170 will respond as if the user released the trigger. Optionally, the predefined time is user selectable.

In some embodiments of the disclosure, the firearm 100 provides an indication if the bullets in the magazine of the firearm have depleted, for example by a vibration engine 180 in the handle of the firearm 100 that provides for example a steady vibration when the firearm 100 is out of bullets. Accordingly, the user receive a tactile indication without needing to examine the firearm 100. Optionally, if the firearm is stuck for any other reason the vibration engine 180 may provide a different type of vibration signal, so that the user knows that he needs to check the weapon.

In an exemplary embodiment of the disclosure, once the user releases the trigger 120 firearm 100 resets controller 170 and begins again to monitor the firearm motion while waiting for the user to engage the trigger 120.

In an exemplary embodiment of the disclosure, sensors 132 or 134 based on optics may be used to determine motion or stability based on analysis of a specific image/target/light remaining within an error window. Alternatively or additionally, sensors 130 based on sensing motion (e.g. an accelerometer, gyroscope or magnetometer) may be used to monitor the motion of the firearm 100. In an exemplary embodiment of the disclosure, controller 170 receives and analyzes the measurements of the pitch (X), roll (Y) and/or yaw (Z) angles as a function of time, and the angular rate of change as a function of time. The measurements can be from before releasing a first bullet and/or after releasing a first bullet. The analysis enables detecting motion patterns of firearm 100 and accordingly to understand the behavior of the user. Based on the analysis, controller 170 may decide if to release additional bullets. Optionally, other sensor measurements (e.g. trigger status monitor 135) can be used to support or alter the decisions of controller 170.

Figure 4A:
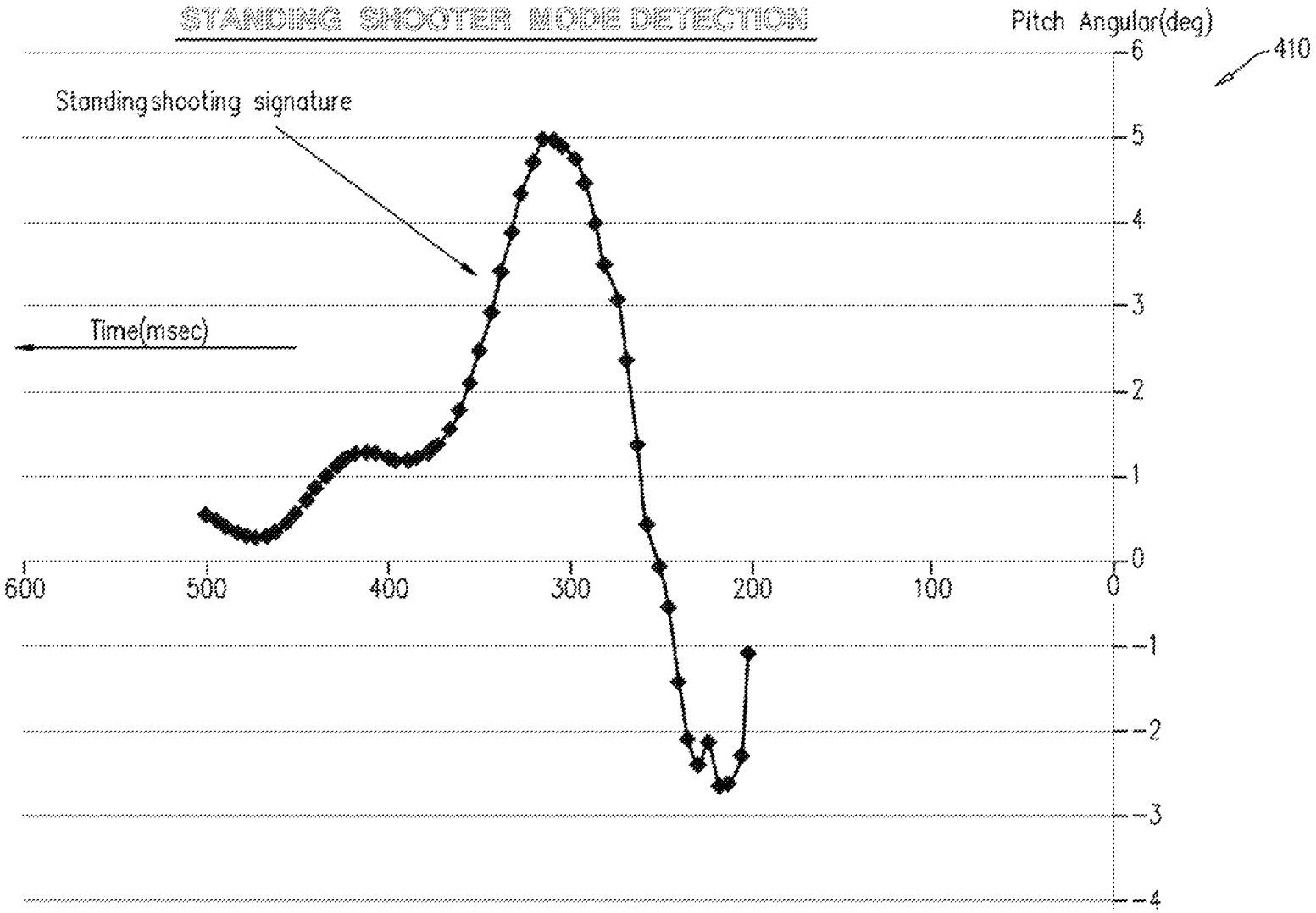
FIG. 4A is a graph illustrating a motion signature of a standing shooter, according to an exemplary embodiment of the disclosure.
Figure 4B:
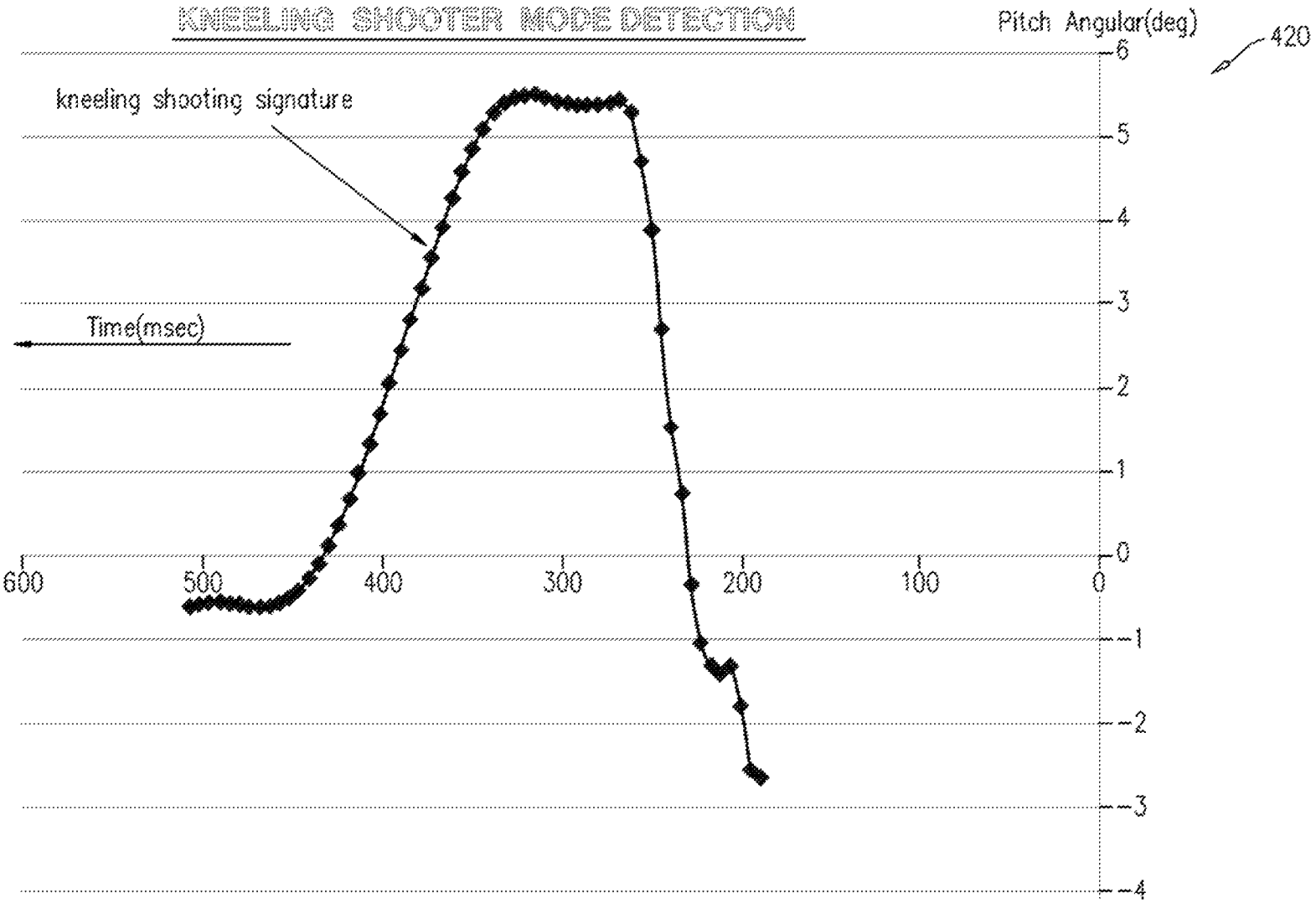
FIG. 4B is a graph illustrating a motion signature of a kneeling shooter, according to an exemplary embodiment of the disclosure.
Figure 4C:
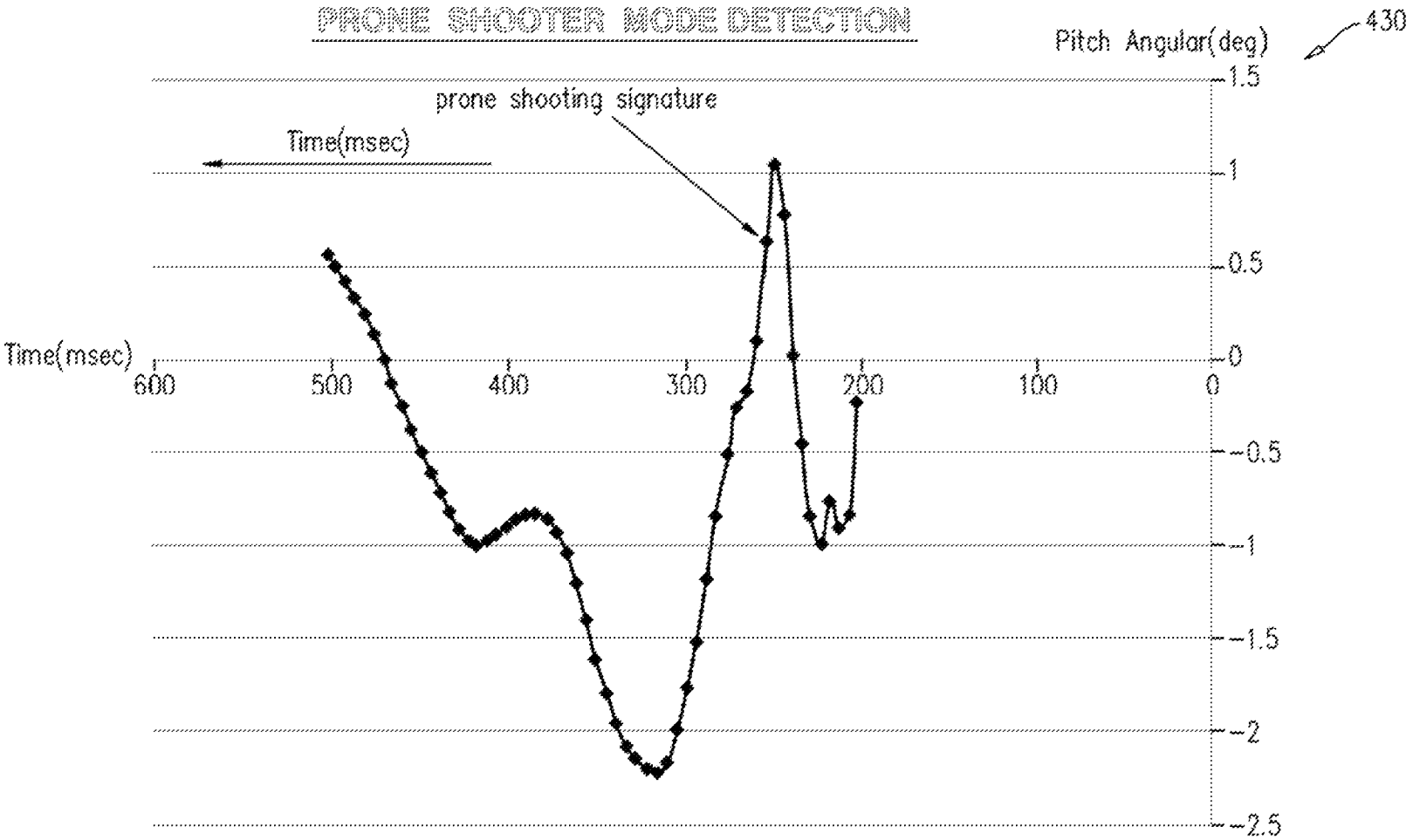
FIG. 4C is a graph illustrating a motion signature of a prone shooter, according to an exemplary embodiment of the disclosure.

In an exemplary embodiment of the disclosure, the motion of the firearm 100 immediately after releasing a bullet provides a unique signature (e.g. based on the pitch angle of a gyro sensor) from which the shooting position of the user can be identified, for example:

1. FIG. 4A is a graph 410 illustrating a motion signature of a standing shooter;
2. FIG. 4B is a graph 420 illustrating a motion signature of a kneeling shooter;
3. FIG. 4C is a graph 430 illustrating a motion signature of a prone shooter.

Optionally, the unique signature appears within about the first 400-500 ms after release of the bullet (time 0). Based on the unique signature controller 170 can identify the shooting position of the user and take further decisions responsive to this identification.

Figure 5A:
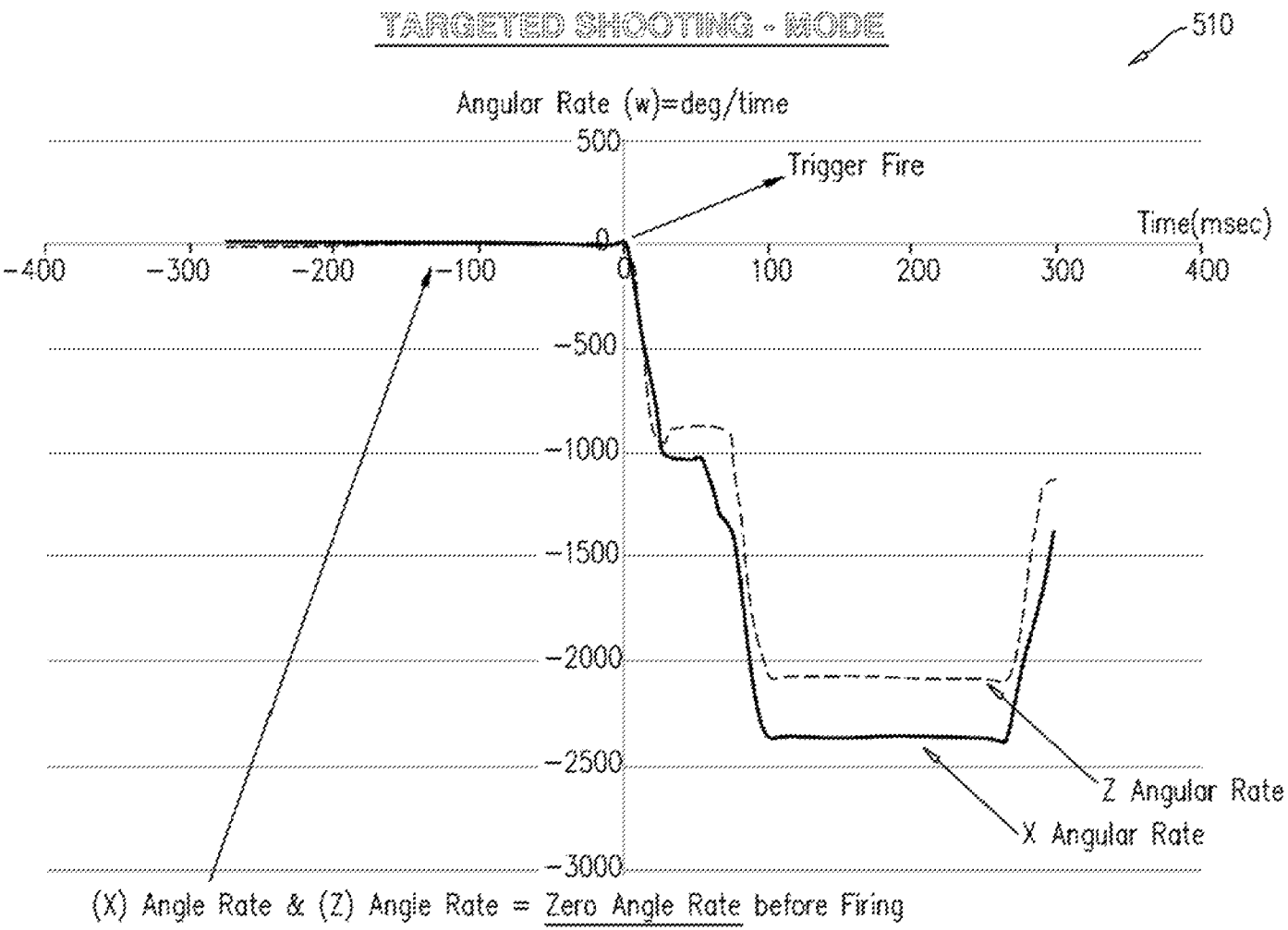
FIG. 5A is a graph illustrating a motion pattern of a shooter aiming and firing at a target, according to an exemplary embodiment of the disclosure.
Figure 5B:
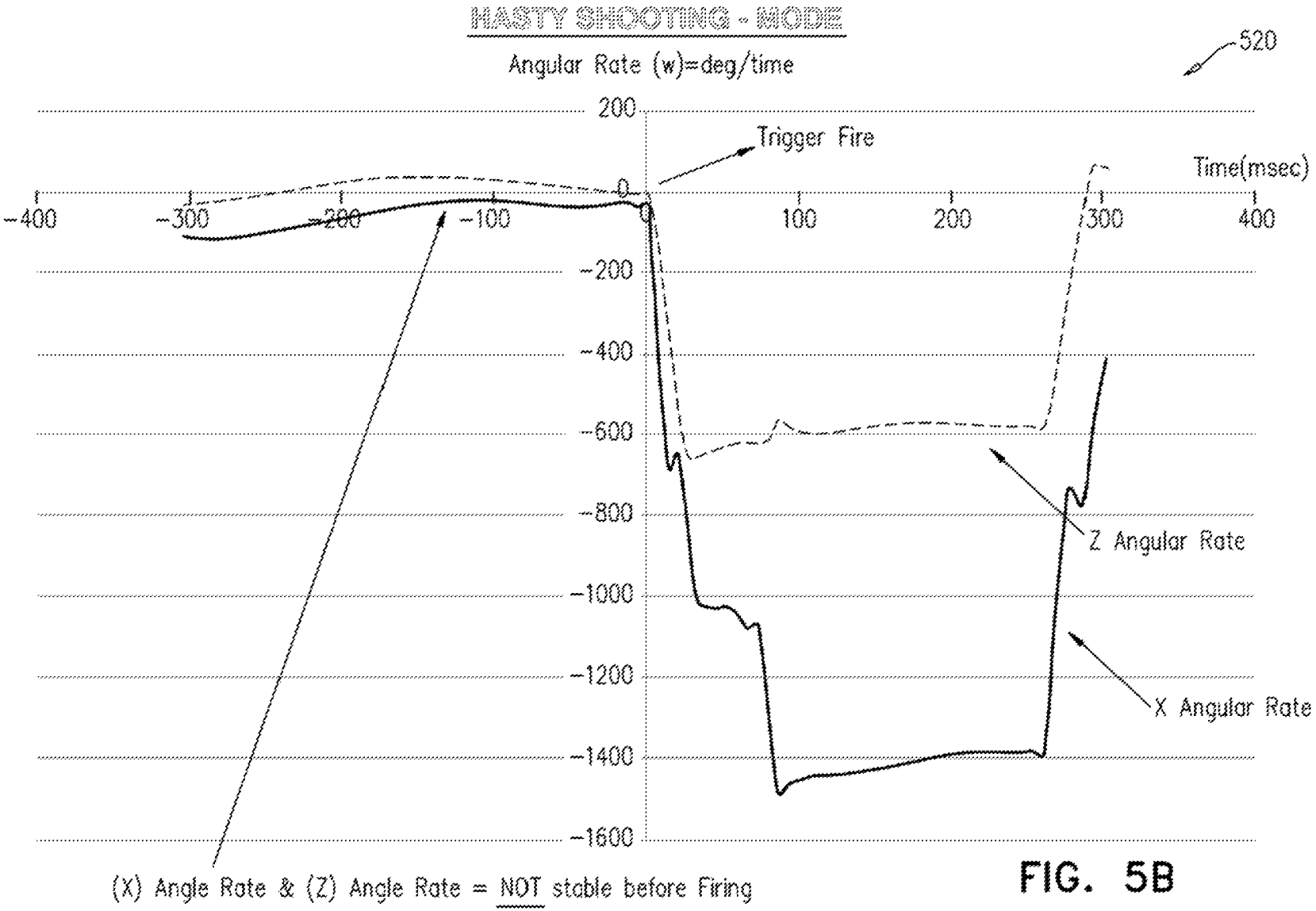
FIG. 5B is a graph illustrating a motion pattern of a shooter hastily firing at a target, according to an exemplary embodiment of the disclosure.
Figure 5C:
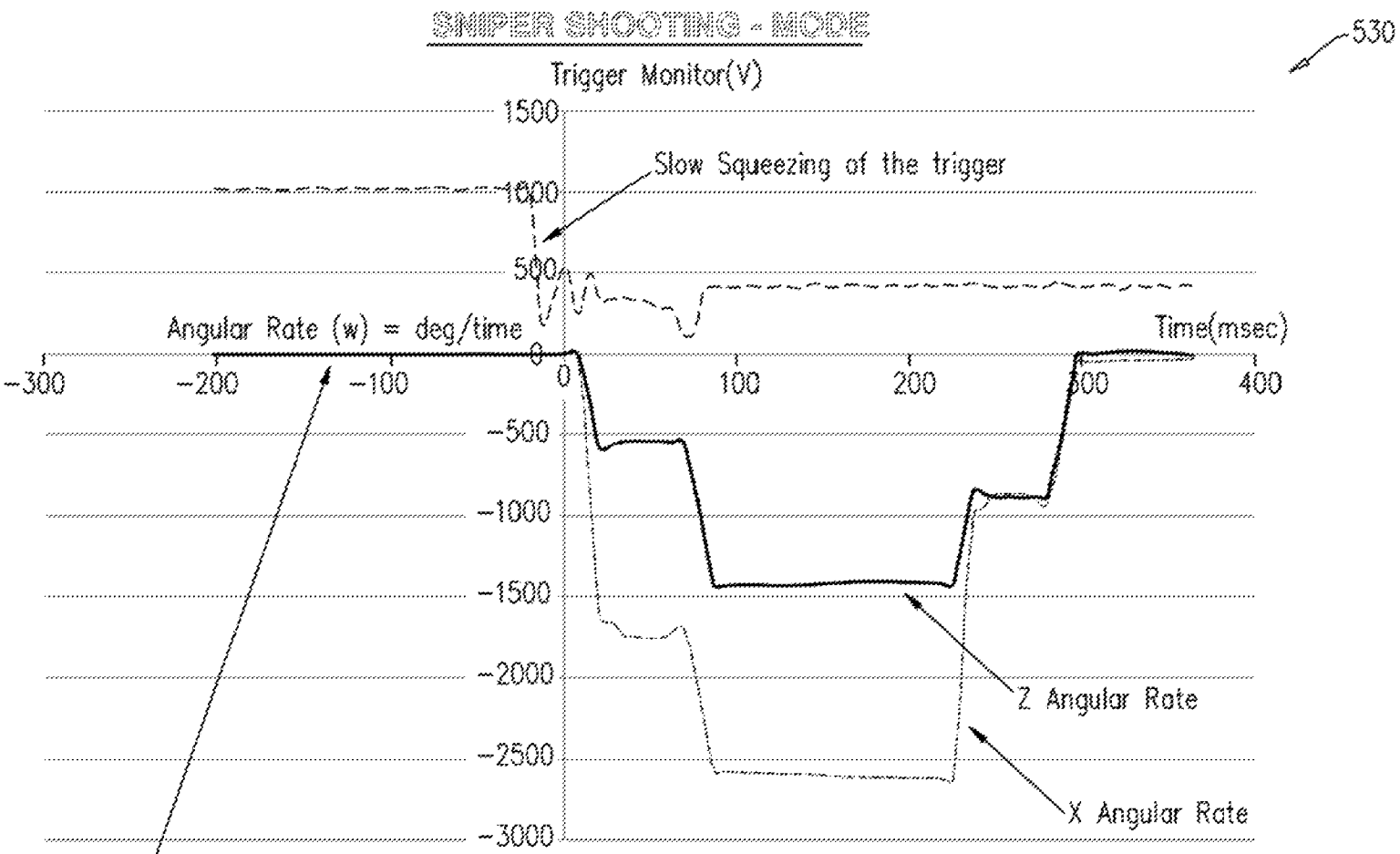
FIG. 5C is a graph illustrating a motion pattern of a sniper shooter firing at a distant target, according to an exemplary embodiment of the disclosure.

In an exemplary embodiment of the disclosure, the angle rate (e.g. degrees/time) of the gyro sensor provides additional information related to the shooting mode of the user. For example by comparing the pitch (X) angle rate of change relative to the yaw (Z) angle rate of change an extent of stability of the firearm 100 can be identified, for example:

1. FIG. 5A is a graph 510 illustrating a motion pattern of a shooter aiming and firing at a target;
2. FIG. 5B is a graph 520 illustrating a motion pattern of a shooter hastily firing at a target; and
3. FIG. 5C is a graph 530 illustrating a motion pattern of a sniper shooter firing at a distant target.

Optionally, the stability of the pitch (X) angle rate of change relative to the yaw (Z) angle rate of change provides an indication if the user is steadily aiming at a target in contrast to a user that is hastily aiming at a target. Likewise the time length of the stability (e.g. more than 2 seconds) can indicate if the user is a sniper or for example a user suddenly confronted by a threat or in combat, so that the user must fire immediately or with less time to aim. In an exemplary embodiment of the disclosure, the trigger status monitor 135 is also used to provide information regarding the motion of the trigger and the time at which the trigger was fully engaged to instruct firearm 100 to release a bullet. The trigger motion can also provide an indication regarding slow trigger squeezing, for example by a sniper, in contrast to engaging the trigger quickly as for example in the case of a user in combat or unexpectedly meeting an opponent and firing hastily.

Figure 6A:
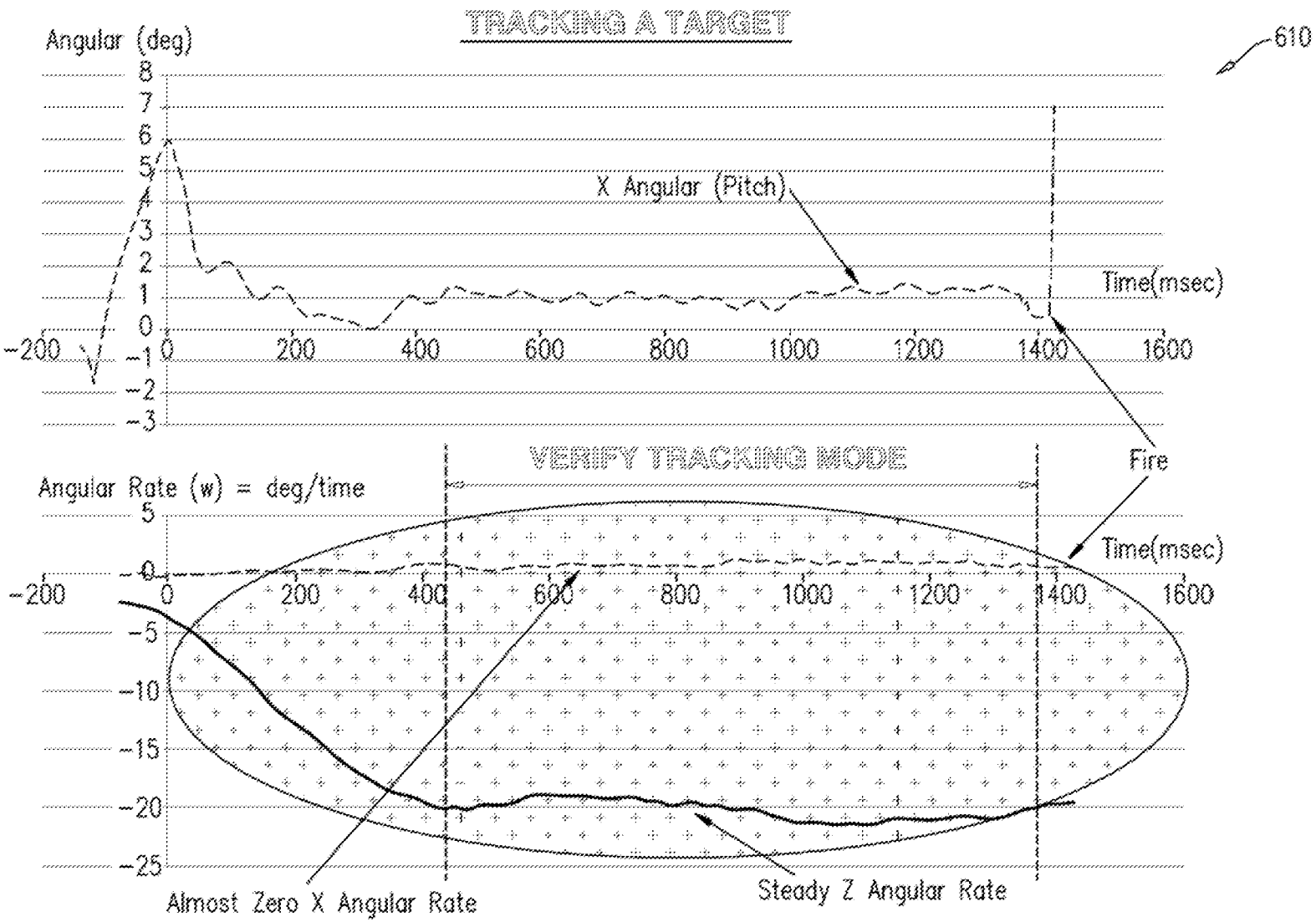
FIG. 6A is a graph illustrating a motion pattern of a shooter tracking a moving target, according to an exemplary embodiment of the disclosure.
Figure 6B:
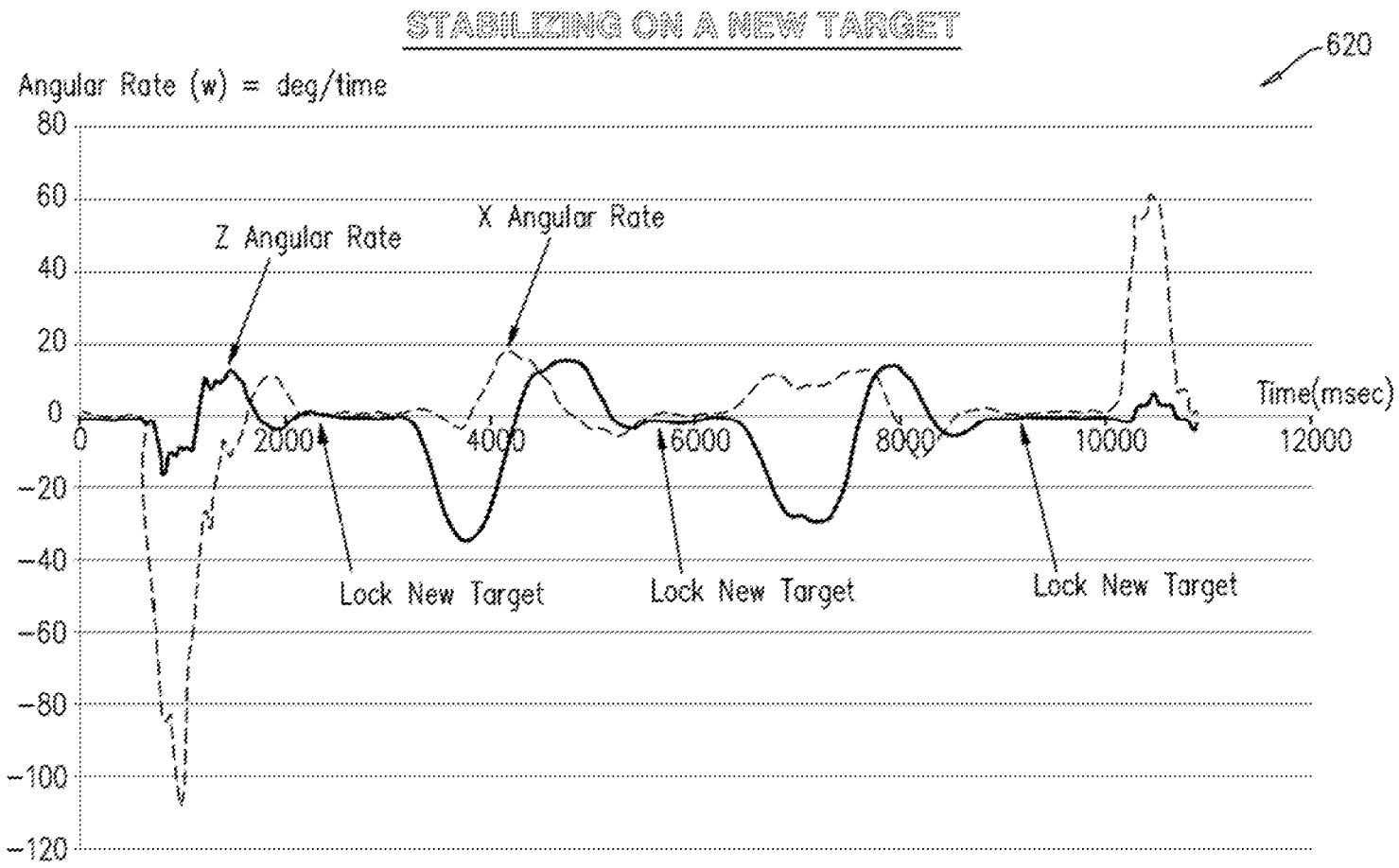
FIG. 6B is a graph illustrating a motion pattern of a shooter stabilizing on a new target, according to an exemplary embodiment of the disclosure.
Figure 6C:
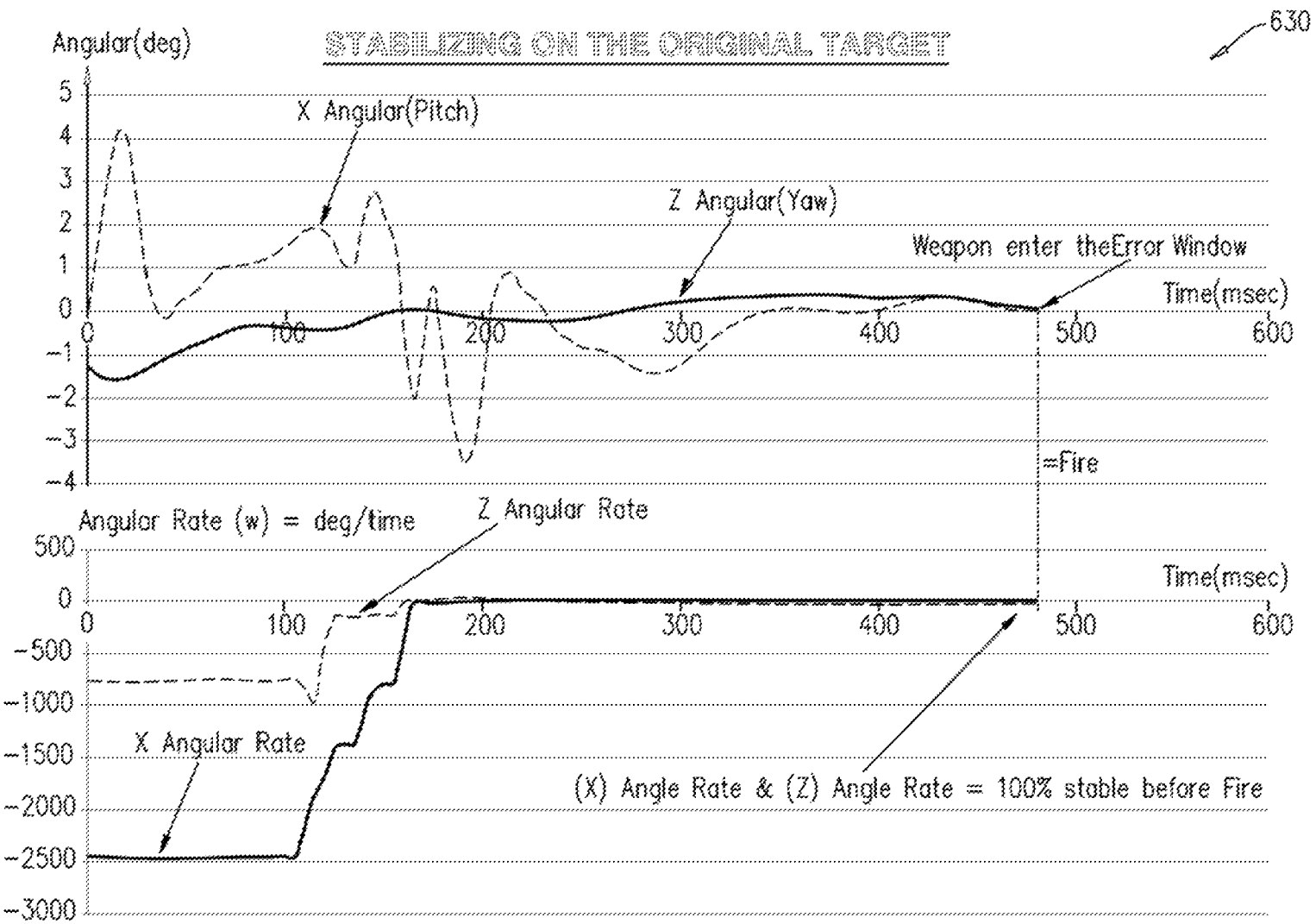
FIG. 6C is a graph illustrating a motion pattern of a shooter stabilizing on an original target, according to an exemplary embodiment of the disclosure.
Figure 6D:
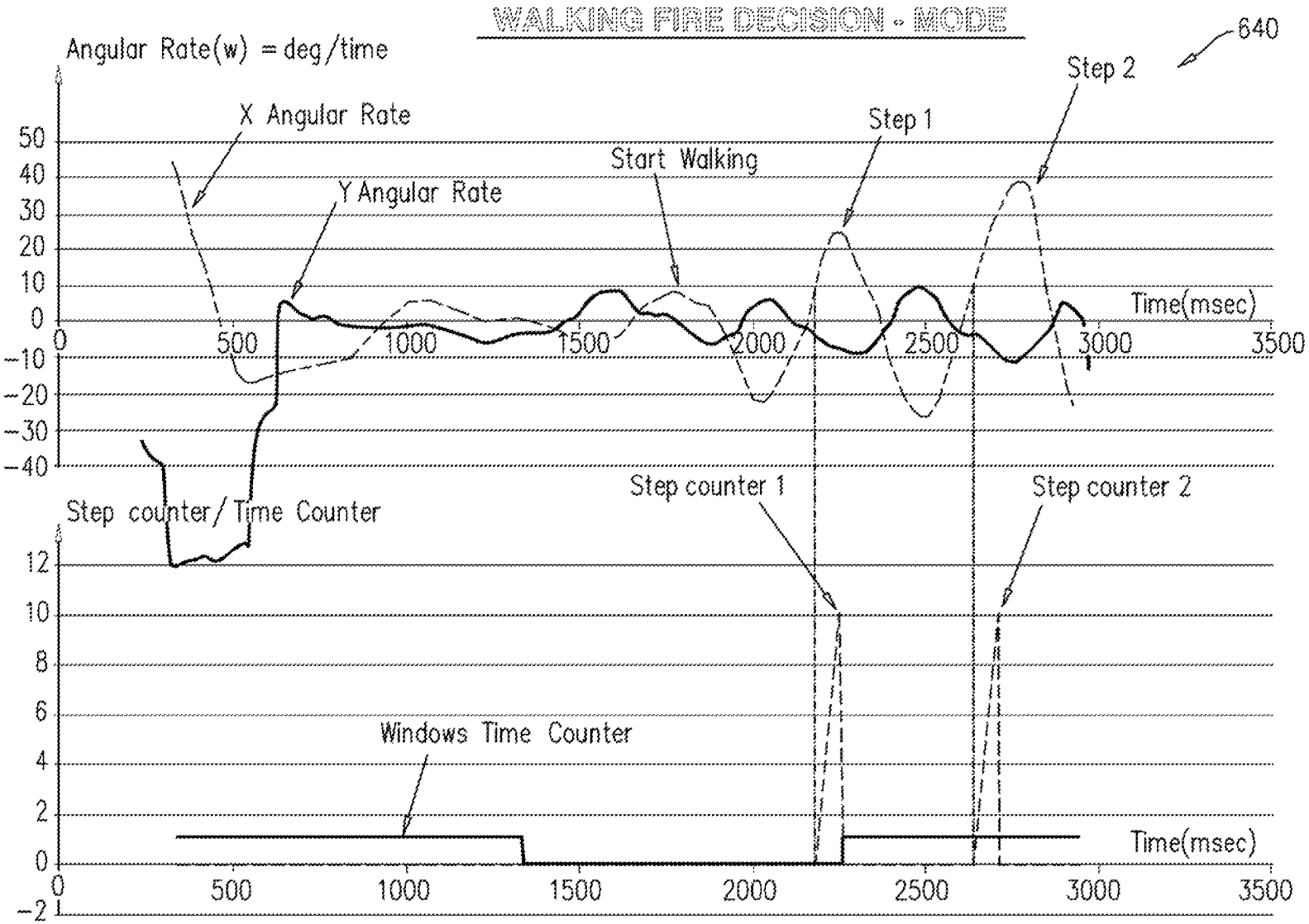
FIG. 6D is a graph illustrating a motion pattern of a walking shooter stabilizing on a target, according to an exemplary embodiment of the disclosure.

As exemplified in FIGS. 4A to 4C and 5A to 5C controller 170 can identify the user position and user mode of operation based on the motion of firearm 100 when releasing the first bullet. In an exemplary embodiment of the disclosure, additional information can be derived from monitoring the angular position of the firearm 100 over time (e.g. pitch (X) and yaw (Z)) and the angular rate of change of the motion of firearm 100. For example:

1. FIG. 6A is a graph 610 illustrating a motion pattern of a shooter tracking a moving target;
2. FIG. 6B is a graph 620 illustrating a motion pattern of a shooter stabilizing on a new target;
3. FIG. 6C is a graph 630 illustrating a motion pattern of a shooter stabilizing on an original target; and
4. FIG. 6D is a graph 640 illustrating a motion pattern of a walking shooter stabilizing on a target.

In an exemplary embodiment of the disclosure, as shown in Graph 610 when tracking a target the pitch (X) angle and rate of change after releasing the first bullet become essentially steady. Likewise the Yaw (Z) angular rate of change also become essentially steady since the firearm 100 is moving at an essentially constant speed (e.g. for more than 1.3 seconds).

Optionally, based on the pitch (X) angular rate of change and the yaw (Z) angular rate of change, controller 170 can identify if the user is stabilizing the firearm 100 toward a target. For example as illustrated in graph 620 if more than 1.3 seconds pass from releasing a bullet and the angular rate of change of the pitch and yaw are both close to zero for more than about 300 ms, this indicates that the user is stabilizing the firearm 100 toward a new target and a bullet should be released.

In an exemplary embodiment of the disclosure, if the pitch (X) angular rate of change and the yaw (Z) angular rate of change indicate that the user is stabilizing on a target and additionally the virtual vector 150 (e.g. based on the pitch (X) and yaw (Z) angles) is within error window 165 of the first released bullet then controller 170 determines that the user is interested in continuing to fire at the original target (e.g. as illustrated in graph 630).

In an exemplary embodiment of the disclosure, motion of a walking user can be identified (e.g. as illustrated in graph 640), for example based on the pitch (X) angular rate of change and the roll (Y) angular rate of change. Typically when a user is walking the two parameters should exhibit an essentially periodic motion based on the pace rate of the user.

Following are some guidelines for programming controller 170 to determine if to release bullets while the user keeps the trigger 120 engaged.

In an exemplary embodiment of the disclosure, as shown in table 1, the user may be in one of six stability modes of operation. Optionally, controller 170 determines the mode of operation based on the measurements before releasing the first bullet and immediately after releasing the first bullet (by engaging the trigger). Optionally, the stability mode may be constant as long as the trigger 120 is engaged or it may change responsive to the user behavior/motion.

TABLE 1

| MODE | TITLE | Stability test Before 1st bullet | Stability test After 1st bullet |
|---|---|---|---|
| M0 | Hasty stability parameters | FIG. 5b - hasty | none |
| M1 | Regular standing + kneeling | FIG. 5A - targeted | FIG. 4A or 4B |
| M2 | Regular prone | FIG. 5A - targeted | FIG. 4C |
| M3 | Walking user | none | FIG. 6D |
| M4 | Target tracking | none | FIG. 6A |
| Sniper + M2 | Sniper + prone mode | FIG. 5C - sniper | FIG 4C |

In an exemplary embodiment of the disclosure, after determining a stability mode for the user, controller 170 may monitor parameters for example as shown in Table 2. Typically the monitored information is analyzed from about 0.5 seconds before releasing a first bullet and continuously until releasing the trigger or when the bullet magazine is depleted. Optionally, the mode may continue after replacing a bullet magazine.

TABLE 2

| Stability mode set before first bullet | Stability mode set approximately from 0.5 seconds before firing the first bullet | Selected mobility mode | Number of stability samples taken about every 2 ms | Initial angle of shooting windows (degrees) | Final angle of shooting window (degrees) | Minimal time for releasing next bullets in ms | Max time for releasing next bullet in ms | Minimal time for searching for new target in ms | Status when magazine empty or elapsed time while trigger engaged |
|---|---|---|---|---|---|---|---|---|---|
| Hasty | non | M0 | 1 | NA | NA | 100 | NA | 0 | No change |
| Sniper | prone | M2 | 700 | 0.015 | 0.015 | 1500 | 2500 | 2501 | No change |
| Regular | Stand/kneel | M1 | 3 | 0.06 | 0.06 | 500 | 1300 | 1301 | Change to M3-M4 |
| Regular | Prone | M2 | 3 | 0.03 | 0.06 | 500 | 1300 | 1301 | Change to M3-M4 |

In an exemplary embodiment of the disclosure, controller 170 determines if to release a bullet based on specific parameters for each mode as shown in Table 2. For example for a prone sniper controller 170 takes about 700 samples in 4 seconds (a sample every 2 ms) and verifies that the shooting angles of the error window is limited to 0.015 degrees. If the firearm motion meets these limitations between a time of 1500 ms to 2500 ms after releasing a bullet the controller 170 will instruct the release of additional bullets (e.g. up to a maximum number of bullets). Otherwise if the firearm 100 does not meet the stability requirements within the allotted time, controller 170 will initiate testing for a new target, for example repeating the test for a new time window or in some modes change to a new stability mode. In an exemplary embodiment of the disclosure, other actions may be taken, for example as shown in Table 3.

TABLE 3

| Stability mode set before first bullet | Maximum time for mode | Actions taken when reaching maximum time | Selected stability mode | Number of stability samples taken about every 2 ms | Elevation Angle of shooting window | Side angle of shooting window | Minimal time for releasing next bullets in ms | Max time for releasing next bullets in ms |
|---|---|---|---|---|---|---|---|---|
| Hasty | 100 | Search to stabilize on new target | M0 | 1 | NA | NA | 100 | NA |
| Sniper | 2500 | Continue until releasing trigger, may find a new target but must keep the Required stability conditions | M2 | 700 | 0.015 | 0.015 | 1500 | NA |
| Regular-new target | 1300 | Identify stabilizing on new target | M1 | 10 | NA | NA | 1300 | NA |
| Regular-walking | 1300 | Detect walking | M3 | 50 | NA | NA | 1300 | NA |
| Regular-tracking | 1300 | Identity tracking, lock new elevation angle after each bullet | M4 | 20 | 0.03 | NA | 800 | NA |

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure.

It will be appreciated by persons skilled in the art that the present invention is not limited to what has been particularly shown and described hereinabove. Rather the scope of the present invention is defined only by the claims, which follow.

We claim:

1. A method of controlling the release of bullets from a firearm by user behavior, comprising:

monitoring the spatial orientation of a virtual vector representing the orientation of a barrel of the firearm by receiving measurements from sensors installed in or on the firearm;

engaging a trigger of the firearm to release a first bullet to a first direction;

while the trigger is engaged continuously analyzing the measurements to identify a match between barrel motion and preconfigured motion patterns of barrel motion;

releasing bullets automatically solely responsive to identifying the preconfigured motion patterns of barrel motion;

wherein the preconfigured motion patterns include an indication that the user is stabilizing the barrel of the firearm in a direction that is distinct from the first direction.

2. The method according to claim 1, wherein the preconfigured motion patterns include an indication that the user is moving the firearm to track a moving target.

3. The method according to claim 2, wherein the preconfigured motion patterns further include an indication that the user is also moving.

4. The method according to claim 1, wherein the preconfigured motion patterns include an indication that the user is stabilizing the firearm toward a stationary target.

5. The method according to claim 4, wherein the preconfigured motion patterns further include an indication that the user is also moving.

6. The method according to claim 1, wherein the indication that the user is stabilizing the firearm comprises aiming the firearm so that it wobbles around an axis directed from the firearm to a target and the wobbling's are essentially restricted within a limited error window around the axis.

7. The method of claim 1, wherein the user selects a behavioral controlled operation mode to enable the firearm to automatically release bullets instead of only releasing bullets manually.

8. The method of claim 7, wherein the firearm includes a separate behavioral controlled operation mode for handling a stationary user and a separate behavioral controlled operation mode for handling a moving user.

9. A firearm that controls the release of bullets based on user behavior, comprising:

one or more sensors that provide measurements to determine the spatial orientation of a barrel of the firearm;

a controller that monitors the spatial orientation of a virtual vector representing the orientation of the barrel of the firearm;

a trigger to indicate that the user is interested in releasing bullets when the user engages the trigger;

wherein a first bullet is released to a first direction when the user initially engages the trigger and while the trigger is engaged the controller is configured to:

continuously analyze the measurements received from the sensors to identify a match between barrel motion and preconfigured motion patterns of barrel motion;

release bullets automatically solely responsive to identifying the preconfigured motion patterns of barrel motion; and wherein the preconfigured motion patterns include identifying that the user is stabilizing the barrel of the firearm in a direction that is distinct from the first direction.

10. The firearm according to claim 9, wherein the preconfigured motion patterns include an indication that the user is moving the firearm to track a moving target.

11. The firearm according to claim 10, wherein the preconfigured motion patterns further include an indication that the user is also moving.

12. The firearm according to claim 9, wherein the preconfigured motion patterns include an indication that the user is stabilizing the firearm toward a stationary target.

13. The firearm according to claim 12, wherein the preconfigured motion patterns further include an indication that the user is also moving.

14. The firearm according to claim 9, wherein the sensors include multiple chips installed on a planar surface, which are rotated relative to each other and each chip comprising an accelerometer and a gyroscope.

15. The firearm according to claim 9, wherein the sensors include an optical sensor or an IR/thermal sensor.

16. The firearm according to claim 9, wherein the indication that the is stabilizing the firearm toward a target comprises aiming the firearm so that it wobbles around an axis directed from the firearm to a target and the wobbling's are essentially restricted within a limited error window around the axis.

17. The firearm according to claim 9, wherein the firearm limits the release of bullets to specific spatial boundaries relative to the first direction.

18. The firearm according to claim 9, wherein the firearm provides an indication if the bullets depleted.

19. The firearm of claim 9, wherein the firearm includes a manual mode and a behavioral controlled operation mode to enable the firearm to automatically release bullets based on user behavior instead of only releasing bullets manually.

20. The firearm of claim 19, wherein the firearm includes a separate behavioral controlled operation mode for handling a stationary user and a separate behavioral controlled operation mode for handling a moving user.

* * * * *